United States Patent [19]

Coleman

[11] 4,343,607

[45] Aug. 10, 1982

[54] SPRAY SYSTEM FOR BREAKDOWN HOIST

[75] Inventor: Cecil A. Coleman, Thomasville, Ga.

[73] Assignee: Balfour Lumber Company, Thomasville, Ga.

[21] Appl. No.: 233,112

[22] Filed: Feb. 10, 1981

[51] Int. Cl.[3] ..... F26B 9/12; F26B 7/00

[52] U.S. Cl. ..... 432/18; 34/13.4; 432/85

[58] Field of Search ..... 432/2, 18, 85; 34/13, 34/13.4, 13.8, 60, 236

[56] References Cited

U.S. PATENT DOCUMENTS

| | | | |
|---|---|---|---|
| 852,068 | 4/1907 | Lambert et al. . | |
| 1,147,244 | 7/1915 | Hodge . | |
| 1,284,336 | 11/1918 | Hodge . | |
| 1,434,879 | 11/1922 | Dodds . | |
| 3,448,530 | 6/1969 | Mortensen . | |
| 3,922,797 | 12/1975 | Dick | 432/85 |
| 4,192,079 | 3/1980 | Brookhyser et al. | 34/236 |

OTHER PUBLICATIONS

Timber Processing, "New Combustor Adapted for Direct Firing", front, pp. 10–12 and 14.

Bete Fog Nozzle, Inc., Catalog 77, pp. 4 and 5, 1977.

*Primary Examiner*—John J. Camby

*Attorney, Agent, or Firm*—Cushman, Darby & Cushman

[57] ABSTRACT

At the breakdown hoist located in a timber processing operation, between a direct-fired ash-producing combustor for generating the heated gas stream for kilning a pile of lumber and the feed for a downstream operation such as planing, at which hoist the kilned lumber is progressively destacked in a tilting, sliding and tumbling operation that results in the shunting-aside of spacer sticks and the conversion of the pile to a single layer of lumber progressing on a feeding deck toward the downstream operation, the exposed upper face of the pile is sprayed with a fog of water sufficient to wet-down the ash so that it does not become an airborne irritant. As to each course in the pile, this wetting-down is completed before that course slides or tumbles from the pile. Preferably the spraying utilizes a bank of full cone fog nozzles.

7 Claims, 1 Drawing Figure

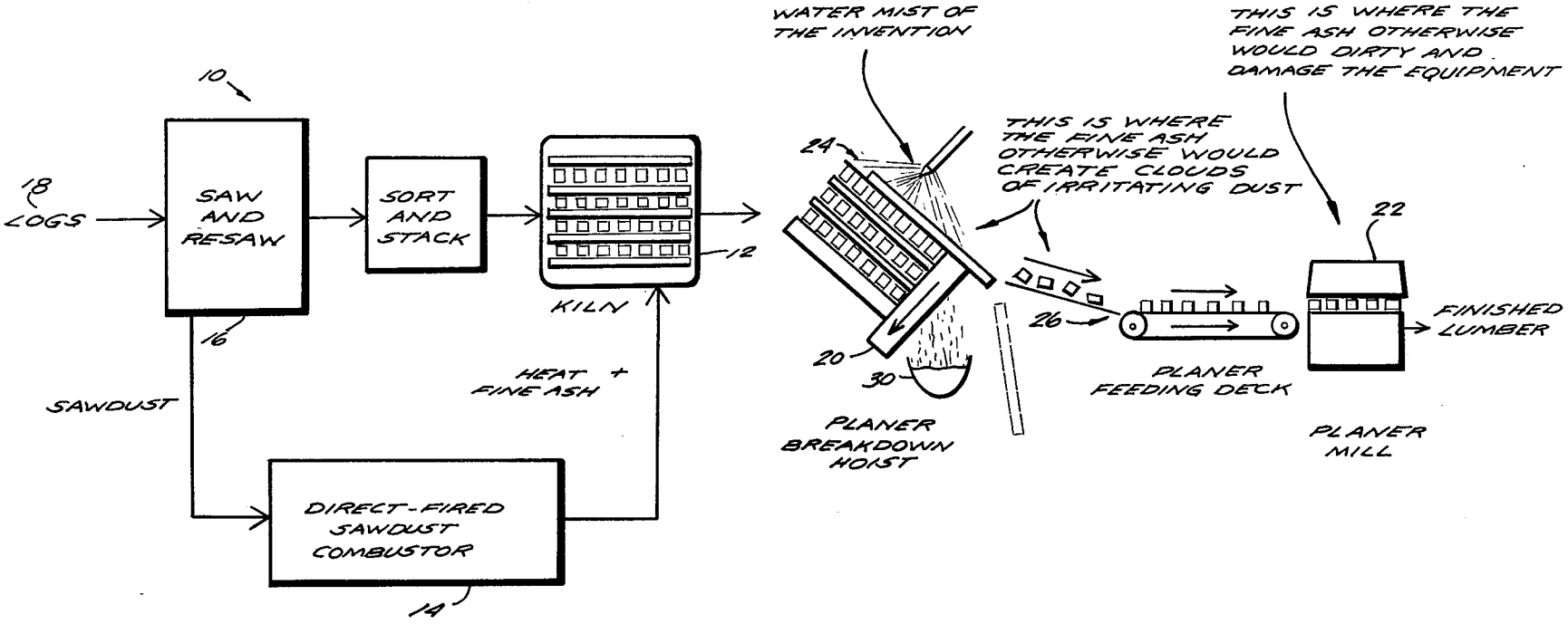
LOGS
18
10
SAW AND RESAW
16
SAWDUST
SORT AND STACK
KILN
12
HEAT + FINE ASH
DIRECT-FIRED SAWDUST COMBUSTOR
14
WATER MIST OF THE INVENTION
24
THIS IS WHERE THE FINE ASH OTHERWISE WOULD CREATE CLOUDS OF IRRITATING DUST
20
30
PLANER BREAKDOWN HOIST
26
PLANER FEEDING DECK
THIS IS WHERE THE FINE ASH OTHERWISE WOULD DIRTY AND DAMAGE THE EQUIPMENT
22
PLANER MILL
FINISHED LUMBER

SPRAY SYSTEM FOR BREAKDOWN HOIST

BACKGROUND OF THE INVENTION

The background and a brief summary of the invention are contained in Griffin, "Combustor Adapted to Direct Fire Kilns", *Timber Processing Industry,* Aug. 1980, front cover and pp 10–12 and 14.

Until recently it was the almost unexceptioned practice to dry lumber after sawing, using the burning of fossil fuel, particularly natural gas to create the necessary heated-gas stream for circulation through the kiln. Various proposals had been made and tried for direct-fired combustors using wood waste, particularly sawdust, as fuel, but incompleteness of combustion has always represented a difficult problem. Lately, as the cost of petroleum has risen, the desire to switch to sawdust as fuel for heating the lumber kiln gas stream has become irresistible. Fortunately, there have been a number of improvements made in combustors in recent years, e.g. the development of fluidized-bed combustion techniques, so that it is now reasonable to burn sawdust, or a mixed fuel largely consisting of sawdust, to produce the heated dry gas stream for kilning lumber.

One unavoidable product of the combustion of sawdust is ash: fine particulate material consisting of that which would not or did not burn completely and that which when burned remained or produced a solid. Under most operating conditions, the great bulk of the ash will fail to become entrained in the heated gas stream, and if so-entrained, will be carried through the kiln in the heated gas stream and removed in the bag house filters on the downstream side of the kiln. However, a certain amount of the particulates will silt-out within the kiln, and some of this will deposit on the lumber being kilned.

Typically, within a modern lumber kiln, a multi-course pile of lumber is subjected as a unit to the heated gas stream. In order to ensure even and thorough treatment the various courses are stacked with the aid of spacing courses—each being an open layer comprising a few sticks placed crosswise to the direction of the lengths of lumber in the immediately subjacent and superjacent courses.

Accordingly, as the stacked lumber is being kilned in a direct-fired sawdust fueled combustor, one can expect the pile of lumber exiting the kiln to bear a deposit of fine ash not just on the outer, upper or exposed lengths in the pile, but throughout the pile, potentially on every piece in each course.

A piece of apparatus has been developed and become widely used for converting the pile of kilned lumber into a single layer of uniformly oriented lengths for further processing, e.g. for planing. One type of such controlled de-stacking apparatus is known as a breakdown hoist.

At a breakdown hoist, one lateral side of the pile of kilned lumber is supported using a weir-like wall means along the full height of the pile and then the pile and wall are tilted so that all courses are supported against this wall. Next the wall is gradually lowered relative to the tilted stack so that support is serially withdrawn from first the upper course of lumber, then from the layer of spacer sticks which immediately underlaid that layer, and so on. Usually, this relative lowering is effected by raising the stack relative to the wall, so that the site where the layers become unsupported remains stationary. Immediately downstream of the site where the uppermost layer of lumber in the tilted pile becomes exposed on its downward-tilted side, there is provided a feeding deck, which may take the form of an inclined set of rails or the like leading down to a conveyor. Usually, this conveyor is the feed conveyor for a further processing station, e.g. a planer mill. A provision is generally made so that each layer of the spacer sticks as it becomes exposed falls down between the tilted stack and the feeding deck, and each layer of kilned lumber as it becomes exposed tumbles down the incline and onto the feed conveyor.

Where an ash-producing direct fired combustor has been used to kiln the lumber, this operation of destacking by tilting, sliding and tumbling is accompanied by the billowing-up of clouds of ash as it is violently shaken-free of the kilned lumber and spacer sticks. And that which remains on and around the lumber entering the planer mill acts as an abrasive on the moving and cutting parts, so that the bearings, planer knives and the like become worn and dull at an excessive rate.

SUMMARY OF THE INVENTION

At the breakdown hoist located in a timber processing operation, between a direct-fired ash-producing combustor for generating the heated gas stream for kilning a pile of lumber and the feed for a downstream operation such as planing, at which hoist the kilned lumber is progressively destacked in a tilting, sliding and tumbling operation that results in the shunting-aside of spacer sticks and the conversion of the pile to a single layer of lumber progressing on a feeding deck toward the downstream operation, the exposed upper face of the pile is thoroughly sprayed with a fog of water sufficient to wet-down the ash so that it does not become an airborne irritant. As to each course in the pile, this wetting-down is completed before that course slides or tumbles from the pile. Preferably the spraying utilizes a bank of full cone fog nozzles.

The principles of the invention will be further discussed with reference to the drawing where a preferred embodiment is shown. The specifics illustrated in the drawing are intended to exemplify, rather than limit, aspects of the invention as defined in the claims.

BRIEF DESCRIPTION OF THE DRAWING

In the Drawing

The sole FIGURE is a schematic flow diagram of a timber processing system utilizing the breakdown hoist spraying system of the present invention.

DETAILED DESCRIPTION OF THE PRESENTLY PREFERRED EMBODIMENT

The exempliary timber processing line 10 illustrated in the drawing is one that is in operation at Balfour Lumber Co., Thomasville, Georgia, U.S.A. The mill is equipped for producing over 40MMBF annually of high grade pine boards and dimension lumber.

Two high temperature kilns, here typified by the unit 12 are served by a York-Shipley fluidized bed solid fuel combustor 14 rated at 26 million BTU/hr., and designed to use green wood residue, e.g. sawdust as fuel. Combustion is continuous and self-sustaining on wood alone after a brief start-up with oil- or gas-fired ignition.

Sawdust for the combustor is collected in an adjacent 11,050 cu. ft. storage silo that is fed by a Rader pneumatic system extending from the sawmill. Automatic controls powered by a DC motor supply sawdust to the combustor based on heat variation within the unit. Simply described, the York-Shipley unit utilizes a 3 ft.-thick bed of sand that is preheated to 750° by a gas blower. At that temperature, sawdust is fed into the bed from above and the combustible type flame reaches an operating temperature of 1500–1700°. Some 5 tons of sawdust is consumed per hour at maximum operation, approximately a third of which is burned in the sand and the remainder in the vapor space developed above the sand. A Zurn multi-cone ash collector removes about a barrel of ash from the system every 24 hours to hold the system within federal air pollution standards.

The kilns are direct fired, i.e. heated gas stream produced by combustion of the sawdust fuel is fed into the kilns where it comes in direct contact with the green lumber in order to dry and cure the lumber.

Some modification of the usual sawing operation 16 is needed in order to produce optimum-quality sawdust for the combustor 14: water application to the saws in the mill is reduced in order to lower sawdust moisture content to 55 percent; the kilns are provided with pressure vents and maintained under positive pressure during firing. Cycle time is about 17 hours for a kiln-load of 4/4 and about 22 hours for a kiln-load of 7/4.

The two kilns 12 are started-up on a staggered basis, with the first one being fired for up to 3 hours prior to starting the second. Typically, the kiln 12 may be a Moore-Memphis kiln having outside fan motors in order to eliminate motor burn-up.

In the particular mode disclosed, the mill 10 is a 7 ft. band mill operation designed for one-pass handling of small logs. Treelength logs 18 are delivered to the band mill and an adjacent two-sided circle mill, collectively indicated at 16. The band mill has 2 infeed decks, one for treelengths and the other multiple lengths, and a pair of kickout bins enabling material delivered treelength to be bucked and relayed to the older circle mill. The band mill concentrates on grade production.

A model 72-51B Terex front loader is assigned treelength unloading/deck supply duties and a model 72-21B Terex handles multiple lengths. The treelength deck is manned by a Prentice 600 k-boom that sorts and places stems onto the conveyor. The shortlog deck is live with stop-and-loader. Treelengths are sized with an 84 in. circle saw and the bolts combined with multiple lengths for processing through a 36 in. Passavant debarker.

A single deck at the mill entrance supplies bolts to a 7 ft. Filer & Stowell band equipped with a 3-block carriage and 10 in. Gardner watergun feed, and teamed with a CM&E slabbing chipper. Usual sawing pattern is for the sawyer to make a single pass on any bolt 6 in. and below and immediately dump it to a 7 ft. Filer & Stowell linebar resaw. The resulting 2-sided cant is sent across to a 10 in. Schurman double arbor, combination gang. A 2-saw Schurman edger is mounted downstream for re-edging pieces from the gang and the resaw.

The headrig sawyer opens 2 faces on bolts 8 in. and larger. Boards are removed from alternate sides until the cant can be run through the 10 in. Schurman combination gang. Extra large logs are double-cut for processing at the gang.

From the landing table, lumber travels through a HEMCO unscrambler and across to a separate "trimroom" equipped with a Brewster 9-unit, dropsaw trimmer. Also extending from the mill floor is a timbers dock equipped with a Prentice H Series k-boom. By-products from both the infeed line and the mill floor are relayed by a 220 ft. Rexnord vibrating conveyor to a Precision 66 in., 8-knife chipper. Sawdust from the mill floor is screened through the vibrating conveyor and picked up by a screw conveyor and relayed by a Rader pneumatic system to the combustor silo. Trim room sawdust is also relayed back to the Rader system.

From the trimmer, lumber travels down a Moseley slot-type sorter where some 50 separations are made. Everything is sent through the sorter except timbers, and with exceptions in the latter, 20 ft. is maximum length processed. Grades include: 4/4 in No. 3, No. 2, D and C & Better; 2×4's in No. 3, No. 2, No. 2 dense, No. 1 dense, and in 2×6's, a dense and select structural; 2×8's in No. 3, No. 2, No. 1 dense, and No. 1 dense select; 2×10's in No. 3, No. 2 and No. 1 dense; and 2×12's in No. 2, No. 3 and No. 1. Shipments are both rough and dressed. Specialty runs include flooring, siding, and even a beaded ceiling run that is a popular export item.

Planer mill machinery is highlighted by a Moore-Jacksonville breakdown hoist 20 and a Yates American A-20-12 planer 22 with 8 and 10 knife heads. Maximum output is about 400 fpm.

The lumber recovered from the dry kilns 12 is commonly covered with a coat of ash that if riled into the air at the breakdown hoist becomes an eye irritant and a nuisance at the planer 22.

In order to control the coating of ash on the dry lumber, the present invention provides a water spraying system 24 over the breakdown hoist 20. This system sprays a light mist of water onto each layer of lumber before is slides from the top of the tilted pile onto the feeding deck 26 of the planer mill 22. The sprayer system 24 makes working conditions more pleasant by wetting-down the ash before it would be jarred off the boards and riled into the air, and helps the planer 22 run cleaner and thus with less wear on the bearings and knives.

Typically, the water is sprayed as a very fine mist using eight Bete fog nozzles supplied by Bete Fog Nozzle, Inc. of Greenfield, Massachusetts, U.S.A. The preferred model is the TFGFC, which provides a full 120° cone spray pattern ranging from 0.7 GPM at 10 PSI to 2.2 GPM at 100 PSI. The selected nozzles are further described in U.S. Pat. No. 2,804,341.

The nozzle rig is mounted so that the nozzles are aimed at the upper course of lumber of the tilted pile on the breakdown hoist, from a distance that is approximately three feet above that course. The nozzles are so spaced as to cover the entire course with sufficient water, before that course slides off, that substantially all of the ash on the course is wetted, and any which is dislodged as a slurry that is collected at 30 and disposed of as solid waste.

It should now be apparent that the spray system for breakdown hoist as described hereinabove, possesses each of the attributes set forth in the specification under the heading "Summary of the Invention" hereinbefore. Because it can be modified to some extent without departing from the principles thereof as they have been outlined and explained in this specification, the present invention should be understood as encompassing all such modifications as are within the spirit and scope of the following claims.

What is claimed is:

1. An improved timber processing system, comprising:

sawing timber to produce lumber and consequentially producing sawdust;

stacking the lumber in a multi-course pile with several generally parallel lengths in each course and adjacent courses are each spaced apart by a respective course of spacer sticks which run at generally right angles to the lengths of lumber in said adjacent courses;

placing the pile in a direct fired kiln;

collecting said sawdust and combusting the collected sawdust to produce an ash-laden hot gas stream, feeding the ash-laden hot gas stream to the kiln for kilning the lumber in said pile, whereby ash from the hot gas stream settles on the lumber during said kilning; and removing the pile of kilned lumber from the kiln and breaking down said pile course-by-course and serially placing each course on a feeding deck to a downstream work station; and spraying the pile of kilned lumber, as it is being broken down course-by-course with a fine mist of water from above, so that before each course leaves said pile substantially all the ash settled thereon during kilning has been wetted.

2. The timber processing system improvement of claim 1, wherein:

said fine mist is sprayed from a plurality of full cone fog nozzles.

3. The timber processing system improvement of claim 1, wherein:

said downstream work station is a planer mill and said system improvement further comprises feeding each of said courses along said feeding deck to said planer mill with substantially all said ash being in a wetted condition from said spraying.

4. The timber processing system improvement of claim 1, wherein:

said pile is broken down course-by-course, by loading it onto a breakdown hoist, and tilting the entire pile against an inclined weir-like wall, and progressively pushing the pile up the inclined wall so that the courses become progressively exposed one-by-one, directing the courses of lumber onto said feeding deck as they succeedingly slide over said wall and shunting away from said feeding deck the courses of spacer sticks as they succeedingly slide over said wall in alternation with said courses of lumber.

5. The timber processing system improvement of claim 4, wherein:

said fine mist is sprayed on to said pile while said pile is being broken down on said breakdown hoist.

6. The timber processing system improvement of claim 5, wherein:

said fine mist is sprayed onto said pile from a plurality of distributed sites located about three feet above the uppermost course on said pile.

7. The timber processing system improvement of claim 6, wherein:

said fine mist is sprayed from a plurality of full cone fog nozzles.

* * * * *